US008393339B2

(12) United States Patent
Upshaw

(10) Patent No.: US 8,393,339 B2
(45) Date of Patent: Mar. 12, 2013

(54) LAYER IT DRY ROLLER

(76) Inventor: Pamela Denise Upshaw, Louisville, KY (US)

( * ) Notice: Subject to any disclaimer, the term of this patent is extended or adjusted under 35 U.S.C. 154(b) by 0 days.

(21) Appl. No.: 12/833,941

(22) Filed: Jul. 9, 2010

(65) Prior Publication Data

US 2010/0269847 A1 Oct. 28, 2010

Related U.S. Application Data

(63) Continuation-in-part of application No. 12/274,457, filed on Nov. 20, 2008, now abandoned.

(60) Provisional application No. 61/004,032, filed on Nov. 23, 2007.

(51) Int. Cl.
*A45D 2/20* (2006.01)

(52) U.S. Cl. ..... 132/247

(58) Field of Classification Search ..... 132/222, 132/247, 270, 250, 223, 226, 256; 24/327, 24/11 M, 15, 349, 454, 457, 460, 267, 703.6
See application file for complete search history.

(56) References Cited

U.S. PATENT DOCUMENTS 2,899,834 A * 8/1959 Anderson ..... 477/123
3,713,455 A * 1/1973 Chen et al. ..... 132/262

* cited by examiner

*Primary Examiner* — Todd Manahan
*Assistant Examiner* — Brianne Kalach

(57) ABSTRACT

A hair roller designed to divide the curl into layers allowing for better penetration of air throughout the hair. This, in turn, leads to shorter drying times.

1 Claim, 2 Drawing Sheets

LAYER IT DRY ROLLER

This application is a continuation in part of U.S. patent Ser. No. 12/274,457 filed on Nov. 20, 2008 now abandoned which claims priority from Provisional Patent Application No. 61/004,032 filed on Nov. 23, 2007.

BACKGROUND INFORMATION

Figure 2:
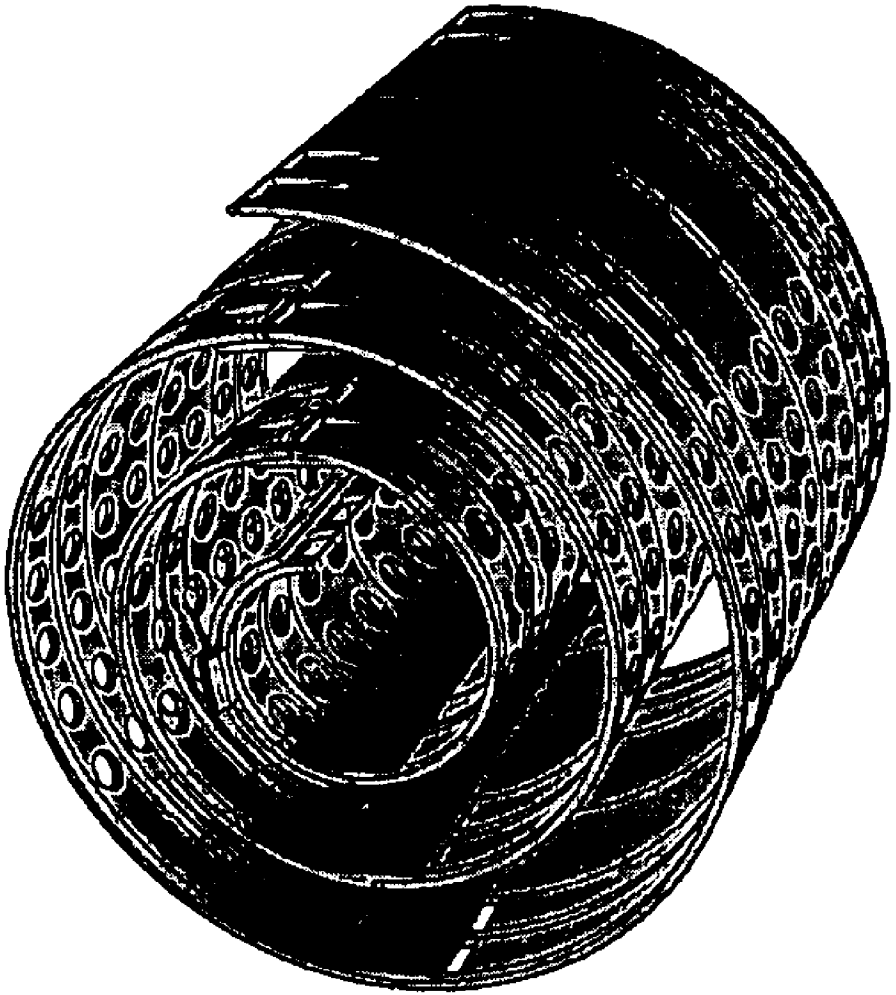

Few changes have been made to the traditional plastic hair roller since it was first developed decades ago. The difference that the "Layer It Dry Roller" offers from the traditional roller is that it contains several rollers intertwined within one (FIG. 2). This multi-tiered roller allows the curl to be divided into layers which enables the air to penetrate the hair more efficiently. The air is allowed to travel through the inside and the outside of the curl at the same time rather than solely blowing on the outside of the hair working its way to the inside. The product found to be the most similar to the "Layer It Dry Roller" was the Self Winding Curler (U.S. Pat. No. 3,590, 829) patented in 1971. The Objective of this roller was to achieve superior body in the client's hair and to produce different curl effects in the hair. However, prior attempts at achieving a successful layered roller in the past have failed for the following reasons:

1) The design of the legs or projections between each roller revolution would cause impressions in the hair. Since flexibility in the material was important, several legs or projections were needed to try to prevent the material from dimpling and buckling.
2) The roundness in the curl was achieved by starting with a rigid core roller and wrapping extended material around this core. This requires all of the layers to lie on top of each other rather than creating open space between each layer.
3) The multiple projections acted as a slight obstacle to air penetration.
4) Once the flexible material was rolled, it tended to retain its curled shape making its re-use impractical.
5) Roller does not roll tightly against the scalp allowing for greater tension at the roots. This will create problems for individuals with kinky or wavy hair.

The "Layer It Dry Roller" solves these problems in several ways. First the roller is not made of flexible material. It is made of the same rigid plastic used to make the traditional roller. The roller is able to create multiple intertwined layers by connecting plastic arches of varying sizes together (FIG. 1 (1.)). The edges of the arches line up evenly so that the connections create one smooth revolution (FIG. 2). Small legs (projections, FIG. 1(4.)) are located on both sides of the arch to hold the spaces between the rollers. Because the legs are located on the far edges of the roller, they will not imprint the hair or obstruct the air flow. Finally, this roller has been designed with characteristics very similar to the traditional roller and works practically the same way. The standard metal clip pin can be used with this roller which will hold it tightly against the scalp and increase the tension on the curl. Projections (legs) or wall thickness do not obstruct use of the metal clip pin.

LIST OF DRAWINGS

Figure 1:
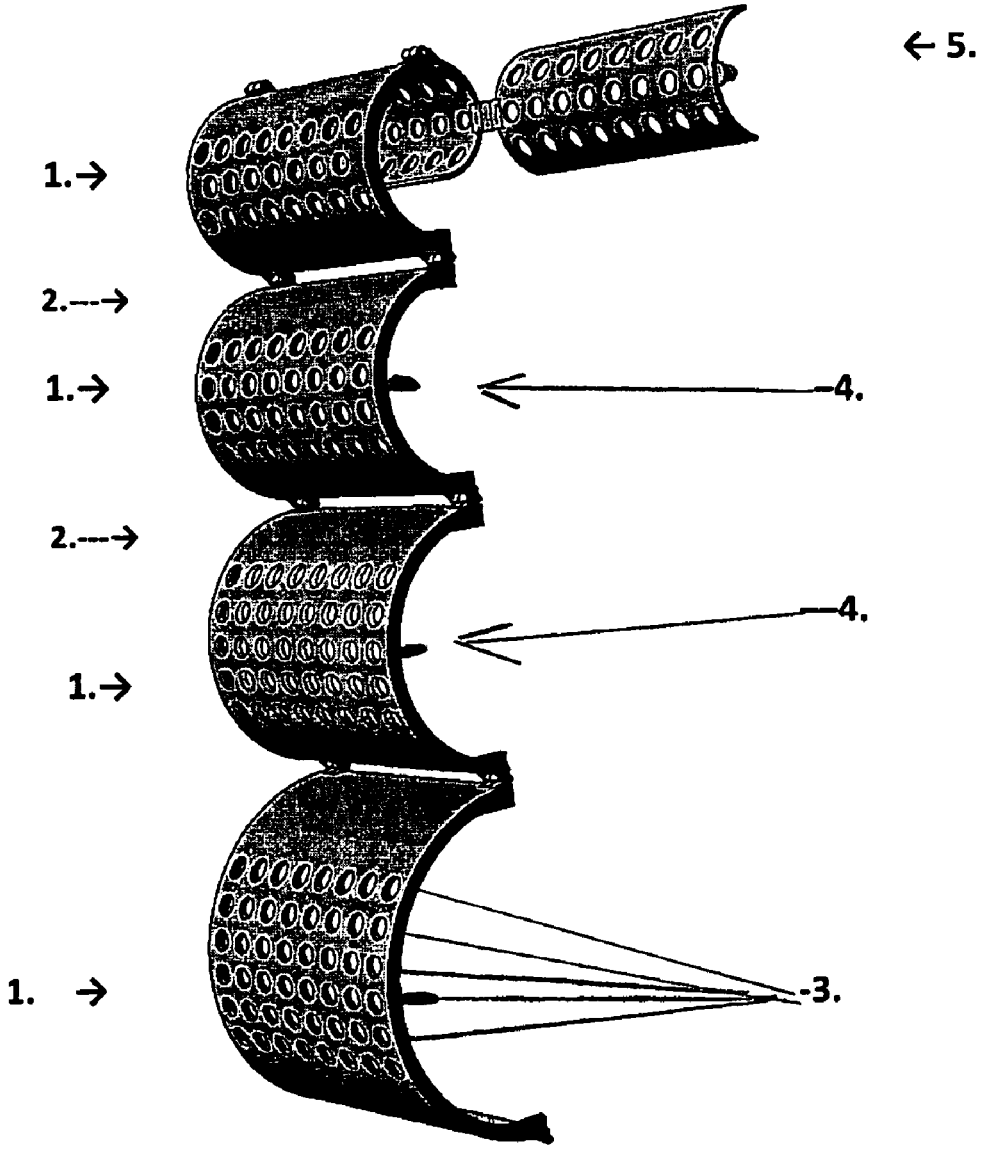

FIG. 1—unrolled hair roller
FIG. 2—fully rolled hair roller

DETAILED DESCRIPTION OF ROLLER

The "Layer It Dry Roller" is comprised of several rigid arches (FIG. 1 (1.)) connected together via a pivoting mechanism (FIG. 1 (2.)) to create one multi-tiered hair roller (FIG. 2). These arches come in multiple sizes (FIG. 1 (1.)), one increasingly bigger than the next and roll together to create circular inner layers (FIG. 2). Each arch is constructed of a very thin layer of material (most likely plastic) very consistent with the traditional hair roller. Several holes have been placed on the roller arches to create additional air flow to the hair (FIG. 1 (3.)). These holes allow air to flow through the top and the bottom of the hair strands. A mechanism used to help keep space between each layer is a projection placed along the outer edges of the arch ((FIG. 1 (4.)). The very first arch may use a cover that holds the initial ends of the hair in place (FIG. 1 (5.)). The "Layer it Dry Roller" may also be used in conjunction with the traditional hair roller.

The invention claimed is:

1. A hair roller, comprising:

a plurality of rigid, thin-walled, elongated, partial-cylindrical members (FIG. 1 (1.)), each having a substantially uniform arch-shaped cross-section, an inner surface, an outer surface, first and second elongated edges and first and second ends, and defining an outside diameter and a first central elongated axis, said plurality of members including at least first, second, and third members, with said first member having a smaller outside diameter than said second member, and with said first and second members and said second and third members being connected together along adjacent elongated edges (FIG. 1 (2.)) for pivoting motion about a pivot axis parallel to the respective central elongated axes, such that, when said first, second and third members are pivoted inwardly about the respective pivot axes, they form a spiral (FIG. 2); and further comprising equal length projections adjacent the first and second ends of at least one of said members and projecting from one of the inner and outer surfaces of said at least one member, wherein, when said members are pivoted into a spiral, said equal length projections on said at least one of said members contacts another of said members to maintain a gap between said one member and said other member that is contacted by the equal length projections (FIG. 1 (4.)).

* * * * *